United States Patent [19]

Golay

[11] Patent Number: 4,473,975

[45] Date of Patent: Oct. 2, 1984

[54] COLUMN HAVING TILTABLE SECTION

[76] Inventor: Paul A. Golay, Greenacres, Appleton Wiske, Nr Northallerton, Yorkshire, England

[21] Appl. No.: 268,981

[22] PCT Filed: 9/24/80

[86] PCT No.: PCT/GB80/00146

§ 371 Date: 5/5/81

§ 102(e) Date: 5/5/81

[87] PCT Pub. No.: WO81/00902

PCT Pub. Date: Apr. 2, 1981

[51] Int. Cl.[3] ..... E04H 12/34

[52] U.S. Cl. ..... 52/29; 52/111; 52/726

[58] Field of Search ..... 52/29, 40, 120, 632, 52/111, 726; 16/390, 386, 366; 403/53, 160

[56] References Cited

U.S. PATENT DOCUMENTS

| | | | |
|---|---|---|---|
| 375,378 | 12/1887 | Perry | 52/40 |
| 2,645,511 | 7/1953 | Rutledge | 403/72 |
| 2,822,066 | 2/1958 | Hanson | 52/120 |
| 2,882,004 | 4/1959 | Leishman | 16/366 |
| 2,985,261 | 5/1961 | Kubesh | 52/40 |
| 3,827,197 | 8/1974 | Adam | 52/29 |

FOREIGN PATENT DOCUMENTS

| | | | |
|---|---|---|---|
| 1250217 | 11/1960 | France . | |
| 991963 | 5/1965 | United Kingdom . | |
| 2063346A | 6/1981 | United Kingdom | 52/120 |

*Primary Examiner*—Alfred C. Perham
*Assistant Examiner*—Michael Safavi
*Attorney, Agent, or Firm*—Roberts, Spiecens & Cohen

[57] ABSTRACT

A column having a base section and a tiltable section, the tiltable section being hinged adjacent the top of the base section by hinge means within the base and tiltable section whereby, the tiltable section may be tilted from it's normal upright position to a position whereby the upper end is adjacent the ground for maintenance of a lamp unit.

16 Claims, 5 Drawing Figures

COLUMN HAVING TILTABLE SECTION

BACKGROUND OF THE INVENTION

The present invention relates to a column and particularly to that type of column having a base section and a tiltable section, the tiltable section being hinged adjacent the top of the base section. The provision of a tiltable section is normally for the purpose of facilitating the cleaning of the lamp or other unit carried at the top of the tiltable section. Such columns are particularly useful in situations where it would not be possible to clean the lamp or other unit at the top of the tiltable section by conventional means.

One of the problems with such columns has been that their appearance is not normally so elegant as normal columns which do not include a tiltable section.

SUMMARY OF THE INVENTION

The present invention provides a column having a base section and a tiltable section, the tiltable section being hinged adjacent the top of the base section intermediate its ends by hinge means whereby, when the tiltable section is in the normal upright position substantially colinear with the base section, the hinge means is entirely within the base and tiltable section.

Thus the hinge is not visible as in normal constructions and this makes for a more elegant column. Furthermore, the hinge will not be exposed to the weather and this further overcomes problems with the conventional hingeing arrangement.

The hinge means may preferably take the form of an arm member which is pivotally connected to the base section and pivotally connected to the tiltable section. The arm is preferably not straight. In a preferred arrangement there may be provided two similar arms arranged parallel to one another and side by side. This improves the structural integrity of the joint between the two sections.

The arm may take a form such that the tiltable section may be tilted from a position in which it is generally colinear with the base section in its normal position through approximately 180° to a position in which it is parallel to and alongside the base section and upside down with respect to its normal position. Alternatively the arm may be arranged such that the tiltable section may be tilted from a position in which it is generally colinear with the base section in its normal position, and through an angle less than 180°, for example approximately 135° to a position in which the upper end of the tiltable section is adjacent the ground. In this case it is necessary to provide means for holding the tiltable section in such a position and this may be provided by means of a wire which extends from the lower end of the base section to the tiltable section.

When the tiltable section is upright in its normal position, the two sections preferably form a continuation of one another, that is, the two sections have the same cross section where they meet and, where applicable, have the same taper.

BRIEF DESCRIPTION OF THE DRAWING

Preferred arrangements of the invention will now be described by way of example only and with reference to the accompanying drawings in which.

DETAILED DESCRIPTION

Figure 1:
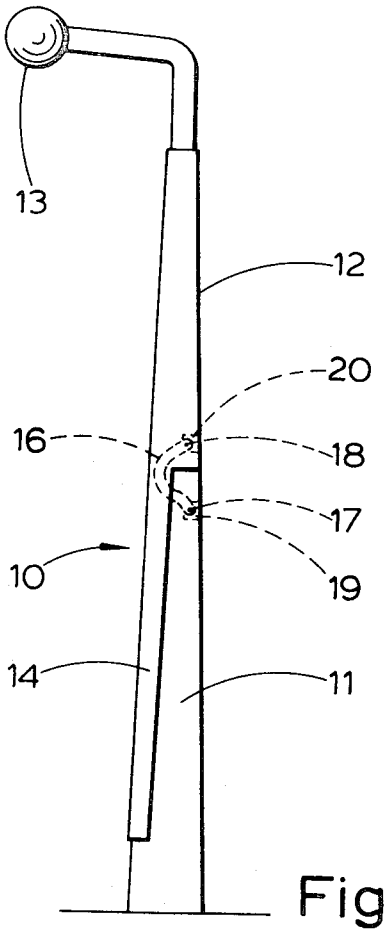
FIG. 1 is a diagrammatic perspective view, partially in section, of a column according to the invention in its normal position.

Referring to FIG. 1 the column 10 comprises a base section 11 and a tiltable section 12. In the present embodiment the base section and tiltable section are each of the same cross section and are formed of folded sheet metal. The cross section is octagonal but other cross sections would of course be suitable.

The base section 11 is mounted uprightly in the ground and includes an access opening and door (not shown) including the normal control gear.

The tiltable section 12 carries adjacent its top end, in this case, a lamp unit 13 and downwardly depending from the joint between the base section 11 and tiltable section 12 is a tail section 14 of the tiltable section 12. The tail section 14 is of similar general cross section to the tiltable section 12 (although, of course, it is not complete) and is arranged to fit snugly alongside the base section 11 in the position shown in FIG. 1. As the cross section is octagonal, the tail section 14 comprises five sides. The tail section 14 acts as a waterproof cover for part of the joint between the base section 11 and tiltable section 12, but where the joint is not covered by the tail section 14 the tiltable section 12 carries a weatherproof strip 20 of the same metal sheet welded thereto.

Adjacent the joint between the base section 11 and tiltable section 12, and within the two sections is mounted an arm 16 which is pivotally connected to both the base section 11 and tiltable section 12 by pivot pins 17, 18 mounted on suitable support blocks 21,22 within the base section 11 and tiltable section 12 respectively. The arm 16 is not straight but curved as is clear from FIG. 1.

The bottom end of the tail section 14 of the tiltable section 12 includes (not shown) means for mounting a wire 15 and means for locking this bottom end of the tail section 14 to the base section 11.

When it is desired to clean the lamp unit 13, the lower end of the tail section 14 is unlocked from the base section 11 and the tail section 14 is pulled away from the base section 11 thereby pivoting the tiltable section 12. Disengagement of the base section 11 and tiltable section 12 is facilitated by the strip 20 which acts as a pivot during the initial tilting. The tiltable section 12 is pivoted at a point, intermediate its ends, whereby it is generally counterbalanced but to control the pivotal movement of the tiltable section 12 the wire 15 is paid out. The pivoting of the tiltable section 12 continues until it reaches the position shown in FIG. 2. It will be understood that to reach this position it is necessary for the arm 16 to pivot around the pin 17 in the base section 11 and for the tiltable section 12 to pivot around the pin 18. In this way the tiltable section is tilted to a position approximately 180° from its normal position whereby it is generally parallel to and alongside the base section 11 and upside down with respect to its normal position. The relative lengths of the parts are arranged such that in this position the lamp unit 13 is adjacent ground level and can be readily cleaned and serviced as required.

Moving the tiltable section 12 back to its normal position requires pulling on the wire 15 attached to the end of the tail section 14, the tiltable section 12 tilting about the pin 18 and the arm 16 pivoting about the pin 17 until the tiltable section 12 reaches the position shown in FIG. 1.

It will be noticed that the hingeing arrangement is entirely enclosed within the base section 11 and the tiltable section 12 and this makes for a neat appearance. Furthermore, the pins and other parts of the hingeing arrangement are within the columns and therefore not subjected to weather and pollution which extends their life compared with the conventional arrangement of a simple pivot pin outside the two sections.

Figure 2:
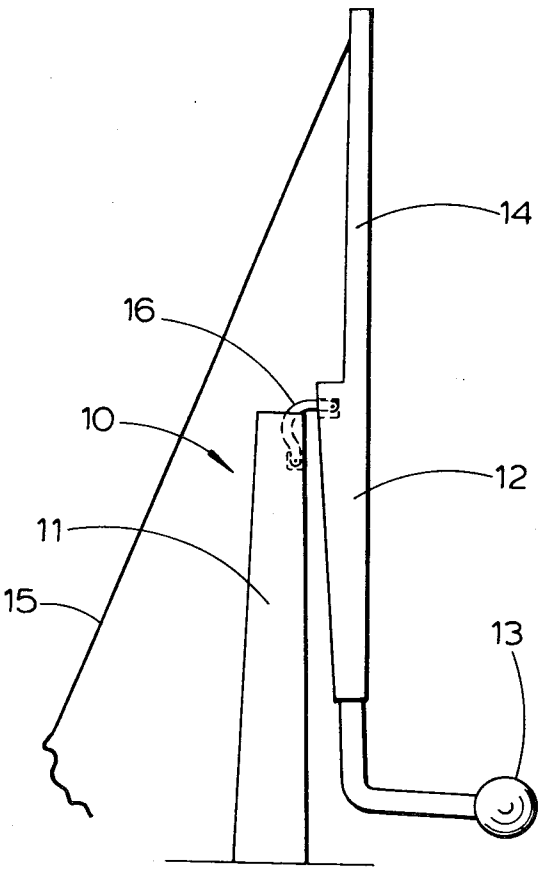
FIG. 2 is the column of FIG. 1 shown in a second position in which the tiltable section has been pivoted through approximately 180°.
Figure 3:
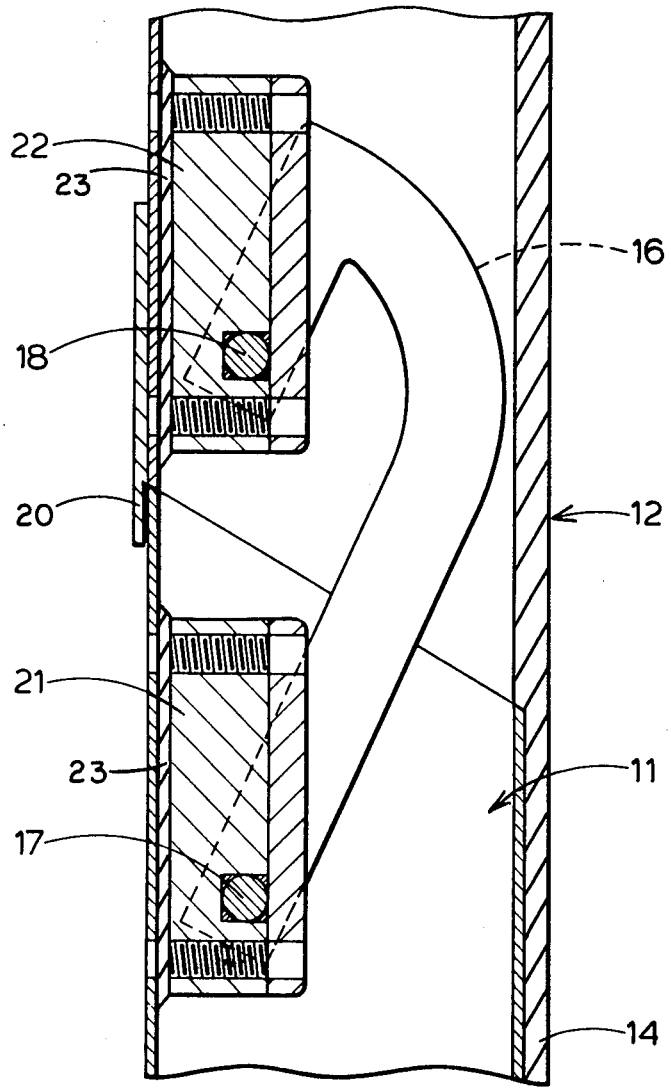
FIG. 3 is an enlarged, vertical sectional view of the joint between the base section and tiltable section of the column of FIG. 1 with a modified arm, the position shown corresponding to FIG. 1.
Figure 4:
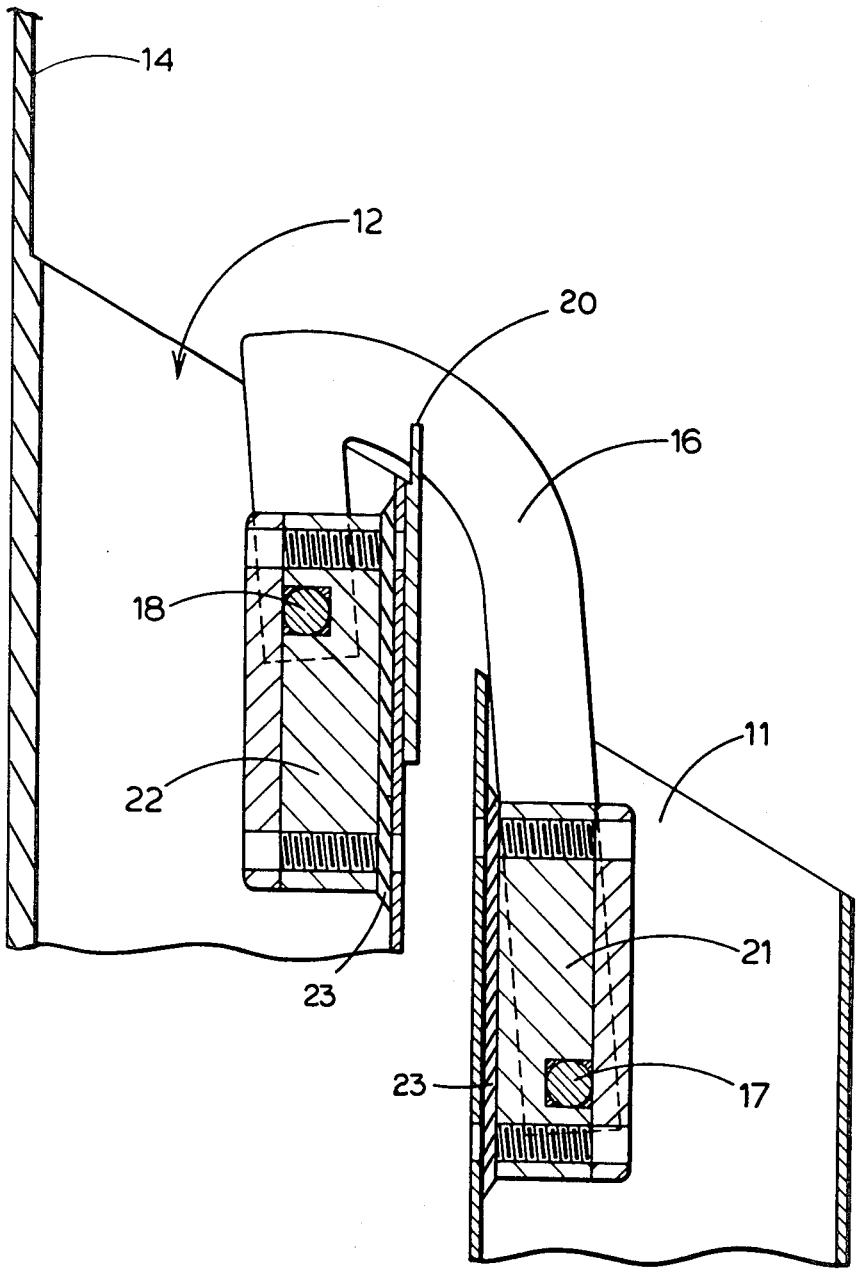
FIG. 4 is a view of the parts of FIG. 3 but in a position corresponding to that of FIG. 2, and, FIG. 5 is a diagrammatic perspective view of an alternative arrangement of column.

FIGS. 1 and 2 are generally diagrammatic and a generally similar arrangement is shown in FIG. 3 and 4 in more detail. FIGS. 3 and 4 are vertical sections through the joint between the base section 11 and tiltable section 12. The same numbers have been used in FIGS. 3 and 4 for parts similar to those in FIGS. 1 and 2.

Thus the pins 17, 18 are mounted in the base and tiltable sections 11, 12 by means of the support blocks 21, 22 welded as shown at 23 to the inside of the respective sections and, although not clear from this drawing, the pivot pins 17, 18 protrude from each side of the support blocks 21, 22 thereby allowing the use of two identical parallel arms 16. This provides greater structural strength in the joint.

The arms 16 are a somewhat different shape from that shown in FIGS. 1 and 2 although still curved. The exact shape of arm 16 is clear from the FIG. 3.

It is also clear from FIGS. 3 and 4 that the upper end of the base section 11 is cut at an angle and there is a corresponding angle at the lower end of the tiltable section 12. Although not shown in this drawing there is provided an overlapping weather strip between the tiltable section and base section 11 to prevent the ingress of water into the column. FIG. 3 corresponds to the position shown in FIG. 1 and FIG. 4 corresponds to the position shown in FIG. 2 (although they are of course mirror images of one another).

Figure 5:
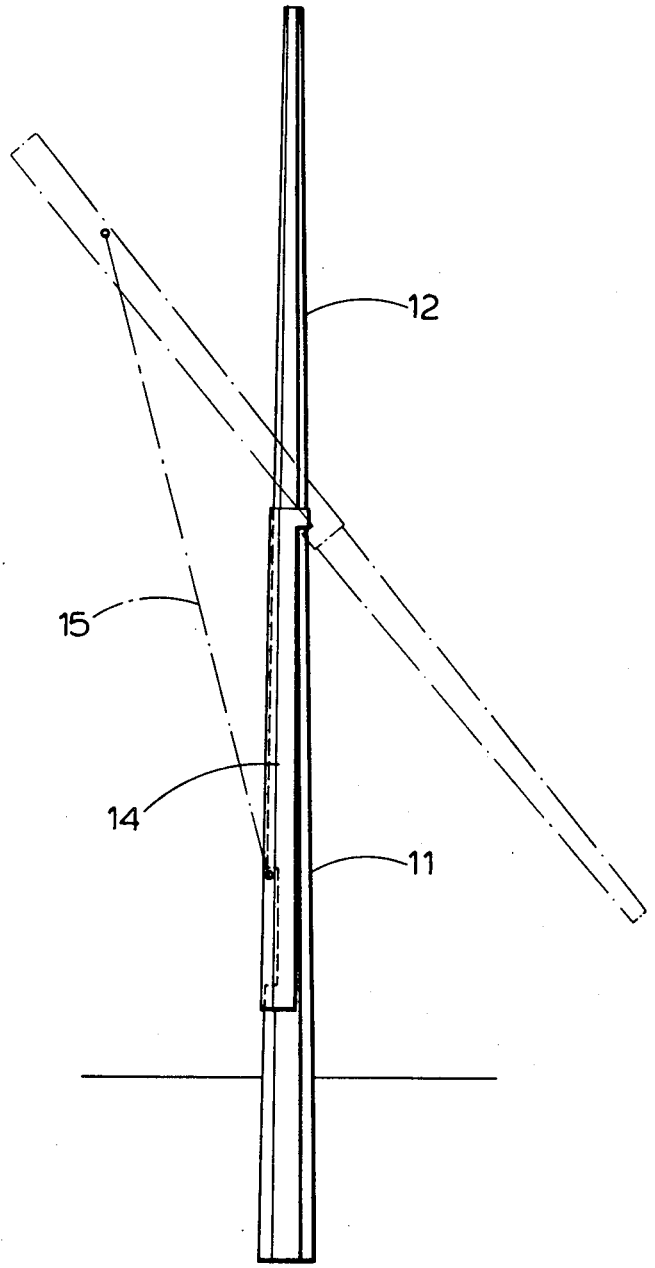

FIG. 5 shows an alternative type of column. The hingeing arrangement is generally similar. The relative lengths of the base section 11 and tiltable section 12 are different (the base section 11 being shorter relative to that shown in FIGS. 1 and 2) so that it is not possible for the tiltable section 12 to rotate through approximately 180° without touching the ground. In this case the maximum pivoting of the tiltable section 12 is through approximately 135° and the tiltable section is restrained from further movement by the wire 15 which is fixed to the lower end of the base section 11. When not in use the wire 15 is retracted into a suitable aperture such as the aperture for the control gear in the base section 11 and is out of sight in normal use.

The invention is not restricted to the details of the foregoing example.

I claim:

1. A column adapted for supporting a lamp or other unit comprising:

an upstanding vertical base section adapted for mounting on the ground, a closed vertical tiltable section, hinge means hinging the tiltable section to the base section adjacent the top of the base section, said tiltable section including a tail section which, when the tiltable section is in its normal upright position extends parallel to, and along side the base section, said tiltable section and base section having walls with inner surfaces defining a substantially closed inner hollow region in said normal upright position, said hinge means:

(a) being constructed to allow the tiltable section to pivot through at least approximately 135° to a position in which the upper end of the tiltable section is adjacent ground level, and, (b) being affixed to said inner surfaces of said sections and situated entirely within the closed, inner, hollow region of the base and tiltable sections when the tiltable section is in the normal upright position whereby the hinge means does not extend through the walls of the sections and is not exposed to the elements.

2. A column as claimed in claim 1 in which the cross-section of the base section is closed.

3. A column as claimed in claim 2 in which the cross-section of the tail section conforms to only a portion of the cross-section of the base section so that when the tiltable section is in its normal upright position and the tail section extends parallel to, and along side the base section it appears to form part of the base section.

4. A column as claimed in claim 2 in which the cross-section of the base section is regular and is non-circular.

5. A column as claimed in claim 2 in which the cross-section of the base section is polygonal.

6. A column as claimed in claim 3 in which the cross-section of the base section and tiltable section are similar.

7. A column as claimed in claim 1 in which the base section and tiltable section are formed of folded sheet metal.

8. A column as claimed in claim 1 in which the hinge means comprises an arm member which is pivotally connected to the inner surface of the base section.

9. A column as claimed in claim 8 in which there are provided two arm members of similar construction arranged parallel to one another and side by side.

10. A column as claimed in claim 8 in which said arm member is pivotally connected to the inner surface of the tiltable section.

11. A column as claimed in claim 8 in which said arm member is non-rectilinear.

12. A column as claimed in claim 1 in which said hinge means is constructed to permit the tiltable section to be tilted from a position in which it is generally colinear with the base section in its normal position through approximately 180° to a position in which it is parallel to and along side the base section and upside down with respect to its normal position.

13. A column as claimed in claim 1 comprising means for holding the tiltable section in a position adjacent the ground.

14. A column as claimed in claim 13 in which said means for holding the tiltable section adjacent the ground comprises a wire which extends from the lower end of the base section to the tiltable section.

15. A column as claimed in claim 1 wherein with the tiltable section upright in its normal position, the two sections form a continuation of one another and the two sections have the same cross-section where they meet.

16. A column as claimed in claim 1 wherein said hinge means comprises a first block affixed to the inner surface of said tiltable section within the interior hollow thereof, a second block affixed to the inner surface of said base section within the interior hollow thereof, a first pin rotatably mounted in said first block, a second pin rotatably mounted in said second block, and an arm hingeably connected to said first and second pins.

* * * * *